US005080600A

United States Patent [19]

Baker et al.

[11] Patent Number: 5,080,600

[45] Date of Patent: Jan. 14, 1992

[54] BREAKAWAY ELECTRICAL CONNECTOR

[75] Inventors: Robert W. Baker, Kenton Harrow; James D. Hutchinson, London, both of England

[73] Assignee: AMP Incorporated, Harrisburg, Pa.

[21] Appl. No.: 578,912

[22] Filed: Sep. 6, 1990

[30] Foreign Application Priority Data

Sep. 7, 1989 [GB] United Kingdom ..... 8920195

[51] Int. Cl.[5] ..... H01R 13/00

[52] U.S. Cl. ..... 439/258

[58] Field of Search ..... 439/152, 153, 155, 180, 439/258

[56] References Cited

U.S. PATENT DOCUMENTS 3,049,690 8/1962 Sparber ..... 439/258

4,684,192 8/1987 Long et al. ..... 439/374

*Primary Examiner*—Joseph H. McGlynn

*Attorney, Agent, or Firm*—William B. Noll

[57] ABSTRACT

An electrical connector assembly is shown having two connector members. The first connector member is a shell having electrical terminals mounted therein. The shell can be fixedly mounted to a base. The second connector member includes a body portion (20) which includes a second plurality of terminals which are matable with the first set of terminals. The second connector member includes a locking ring assembly (130) comprising a forward lock ring (50), a center stop ring (70) and a rear lock ring (100). A lanyard (40) is fixed to the connector body yet resides within a groove (84) of the center stop ring (70). Tension on the lanyard (40) causes a camming effect between the lanyard (40) and the stop ring (70) and causes the stop ring (70) to rotate, thereby disconnecting the first and second connector members.

3 Claims, 4 Drawing Sheets

BREAKAWAY ELECTRICAL CONNECTOR

BACKGROUND OF THE INVENTION

The subject invention relates to an electrical breakaway connector having improved release characteristics.

Such an electrical connector is useful and almost mandatory in applications where emergency situations occur requiring immediate disconnection of the mating connectors with only a small tensile force placed on the two cables which lead out of the connectors. It is also mandatory in these emergency situations that the two connectors do not become cocked or otherwise bound during disconnection which could hamper or prevent the disconnection between the two mated connectors.

One such application of breakaway connectors having emergency disconnection requirements is in the aircraft pilot's helmet, a breakaway connector is typically mounted to the base of the aircraft and a matable connector is connected to the pilot's helmet through data and power cable. The sophistication of the helmets has grown to require a multitude of signal and power contacts mounted within a small connection package, yet with the requirement that the mated connectors are easily disconnected. The breakaway aspect of the connector is critical in that during emergency ejection of the pilot, the connector must be released without undue binding of the two connectors.

A further requirement of the breakaway connector is that the connector upstands vertically in the disconnected position such that the connector is always upwardly facing vertical and therefore the pilot need only use one hand to connect or disconnect the half to his or her helmet. This of course is an ergonomic consideration rather than a safety consideration, yet an important consideration when viewing the cramped quarters which are found in military aircraft. With one connector mounted to the base of the aircraft, undue burden and inconvenience would be placed upon the pilot to require him or her to reach over with the second hand to make the connection between the aircraft connector and the helmet connector.

One breakaway connector is shown in U.S. Pat. No. 4,684,192 which includes an aircraft connector which is connectable to the base of the aircraft and a helmet connector half which is provided with the pilot's helmet. The aircraft connector is connected to the aircraft base by means of a lanyard making the aircraft connector moveable relative to the base of the aircraft, yet it does not allow the connector to upstand in a given position for the ease of connection and disconnection.

Another breakaway electrical connector is shown in pending GB application 8826638.2 where the disconnection aspect involves a lanyard 32 which, when pulled, disengages a pawl from a notch 88, allowing the connector halves to disengage.

SUMMARY OF THE INVENTION

The above mentioned objects were overcome by designing a connector assembly having first and second connector members, where the first said connector member includes a mating front section and a first plurality of electrical terminals. The second said connector member comprises a connector body member housing a second set of electrical terminals, and a locking ring means is operatively connected to the connector body and rotatable relative thereto. The second connector member further comprises a lanyard which is attached to the connector body and operatively connected to the locking ring means, such that axial tension on the lanyard causes a torsion on the locking ring means, and thereby a disconnection of the first and second connector members.

In the preferred embodiment, the connector assembly locking ring means includes a radial or circular groove which carries the lanyard.

Preferably, the locking ring means has a detent means which allows first and second detented positions of the locking means and the connector body.

Preferably, the locking ring means comprises a stop ring and a forward lock ring operatively connected together.

In the preferred embodiment, the forward lock ring and the first connector member include complementary threaded portions to lock the two connector members together.

Preferably, the forward section of the second connector member is spherically shaped, such that the second connector member can be removed from the first connector member at an angle relative to the connection axis.

For a better understanding of the present invention and to show how it may be carried into effect, reference will now be made by way of example to the accompanying drawings.

BRIEF DESCRIPTION OF DRAWING

FIG. 3 is an enlarged view of the connector body;

DETAILED DESCRIPTION OF PREFERRED EMBODIMENT

Figure 1:
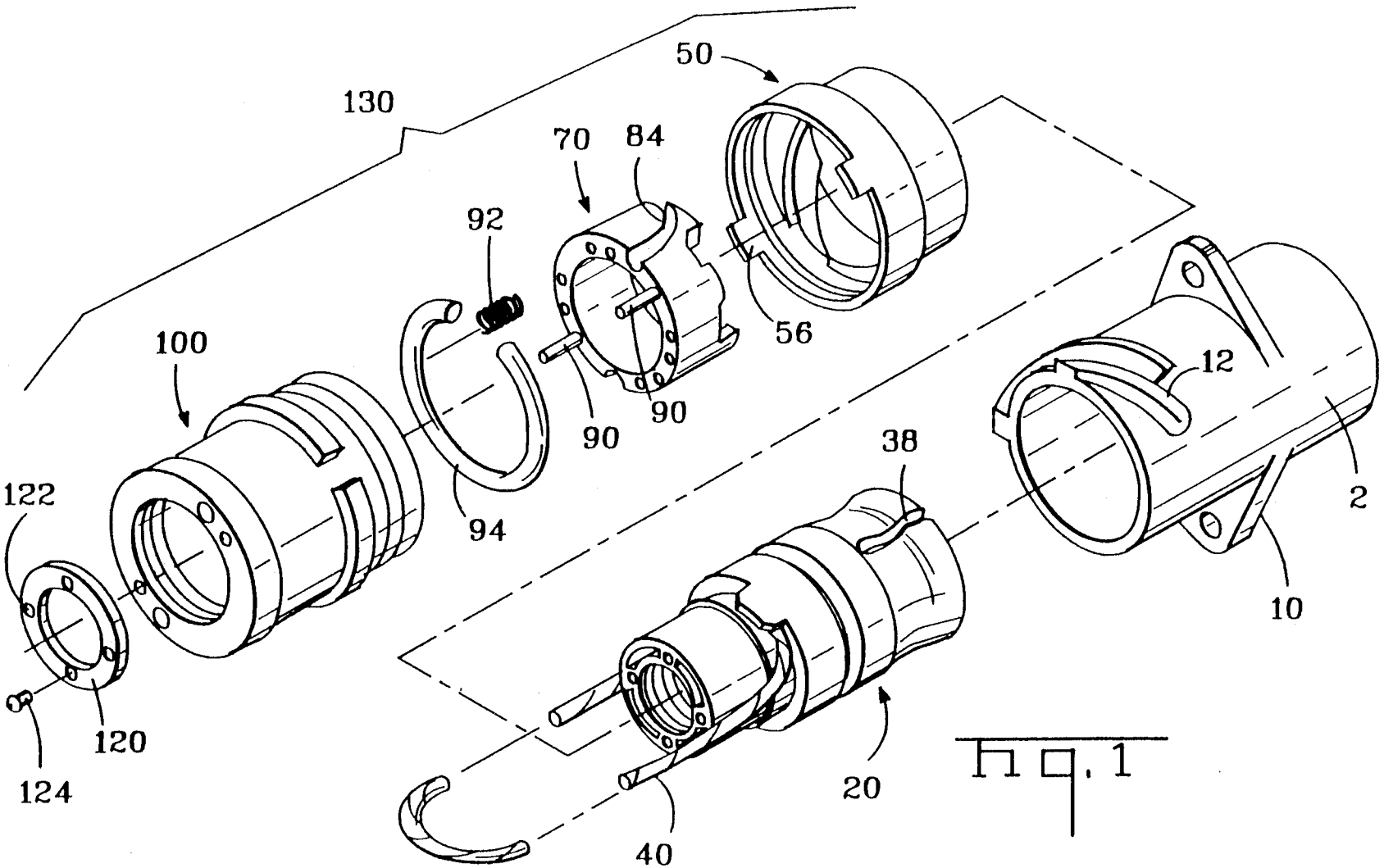
FIG. 1 is an exploded view of a quick disconnect electrical connector in accordance with the teachings of the present invention.

With reference to FIG. 1, the overall assembly of the quick disconnect assembly will be reviewed. The connector assembly generally includes a shell section which would be fixedly mounted to the aircraft via the mounting flange 10. The remaining components of FIG. 1 relate to the connector assembly which make up the pilot's connector and which would be electrically connected to the helmet via electrical cable.

With reference still to FIG. 1, the pilot's connector includes a body section 20 having a lanyard 40 fixedly attached thereto. The body 20 is then sandwiched between the forward ring 50, and the stop ring 70 and the rear ring 100 to complete the assembly.

It should be understood that the internal electrical structure of the connector is similar to pending European Patent Application Number 89302801.9, and will not therefore be discussed, other than to say that the electrical sockets and terminals are fixed within the shell member 2 and connector body 20 for electrical interconnection to each other.

Figure 2:
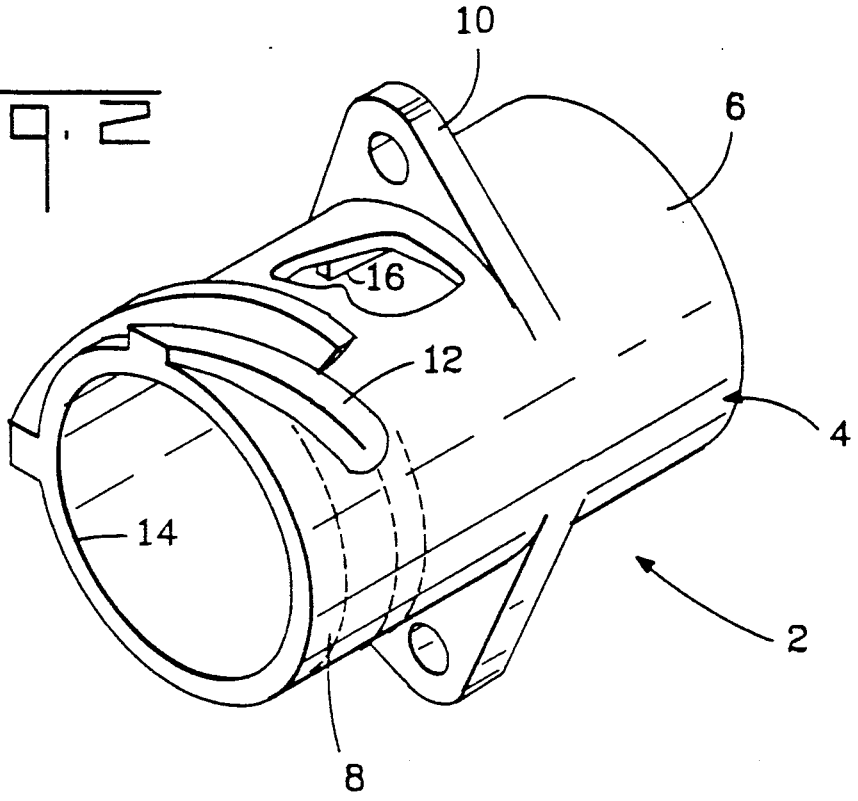
FIG. 2 is an enlarged view of the shell member of the connector assembly.
Figure 7:
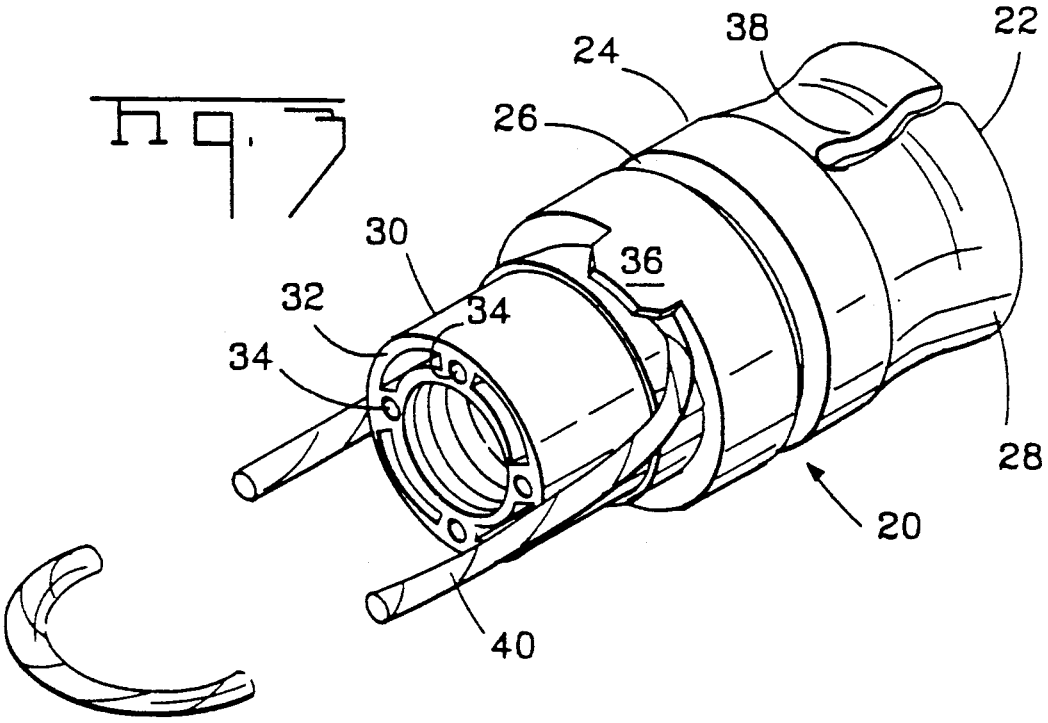

With reference now to FIG. 2, the shell 2 of the connector assembly will be discussed in greater detail.

The shell 2 consists of a cylindrical body section 4 having a rearward wire receiving portion 6 and a forward mating section 8. The forward mating section 8 includes an external threaded section 12 extending around the entire exterior periphery of the shell, and a keyed projection 16 on the interior periphery 14 of the shell.

Referring now to FIG. 3, the connector body 20 includes a mating front section 22 which has a spherically shaped section 28, and has an alignment slot 38 extending from the front edge of the section 22 rearwardly. The connector body also includes a rear section 30 having a rear face 32, with threaded holes 34 therein. The cylindrical portion 24 of the connector body 20 has a groove 26 for receipt of a conductive seal or O-ring 131 as will be described in greater detail hereafter. At the end of the cylindrical section 24, two cam members 36 are included (only one is shown, the other cam member is diametrically opposed from the one member 36 which is shown). A lanyard 40 is also installed through the connector body 20 beneath the cam members 36.

Figure 4:
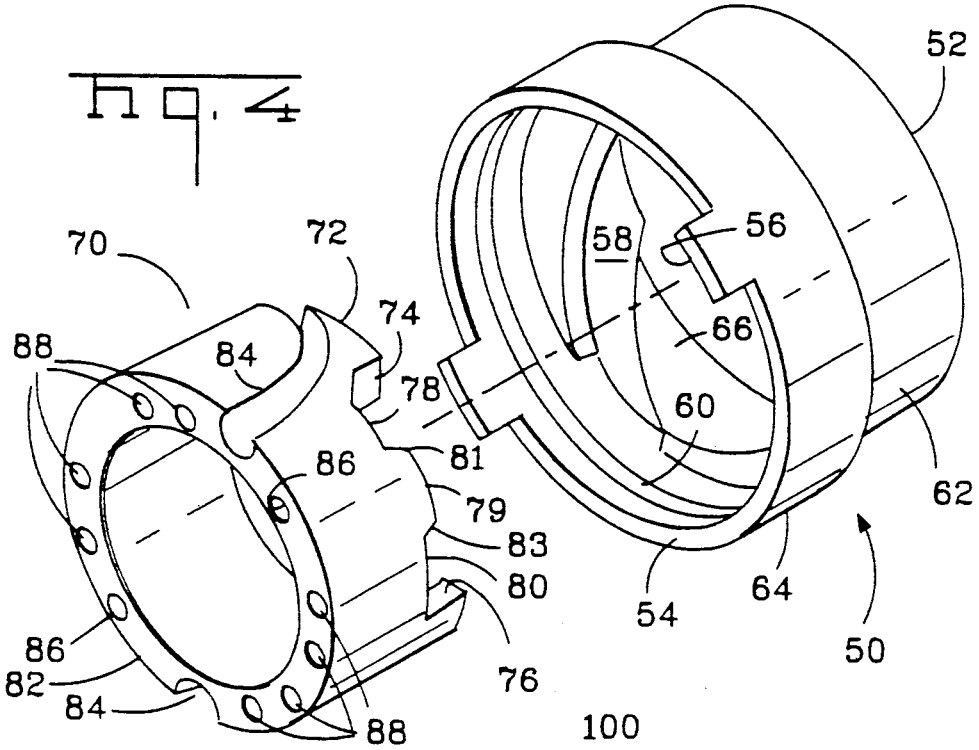
FIG. 4 is an enlarged view of the forward locking ring and stop ring.

Reference now to FIG. 4 shows the forward locking ring 50 having a front section 62 which includes on its interior surface 66 thereof, threads 58 extending from the front edge 52 and extending rearwardly thereof, which are matable with the threads 12 on the connector shell 2. The locking ring 50 also includes a rearward section 64 having a groove 60 on the interior periphery thereof, and further includes locking portions 56 extending from the rear edge 54.

With reference still to FIG. 4, the stop ring 70 is shown as comprising a cylindrical body having two cam stops 78 and 80 formed within the front leading edge thereof, and with an abutment member 79 separating the two cam stops 78 and 80. On either side of the cam stops are stop surfaces 74 and 76. The stop ring 70 also includes two curved grooves 84 for receipt of the lanyard on each side of the stop ring 70. The rear edge 82 of the stop ring 70 includes apertures 86 for receipt of alignment dowels 90, and apertures 88 for receipt of a plurality of compression springs 92.

Figure 5:
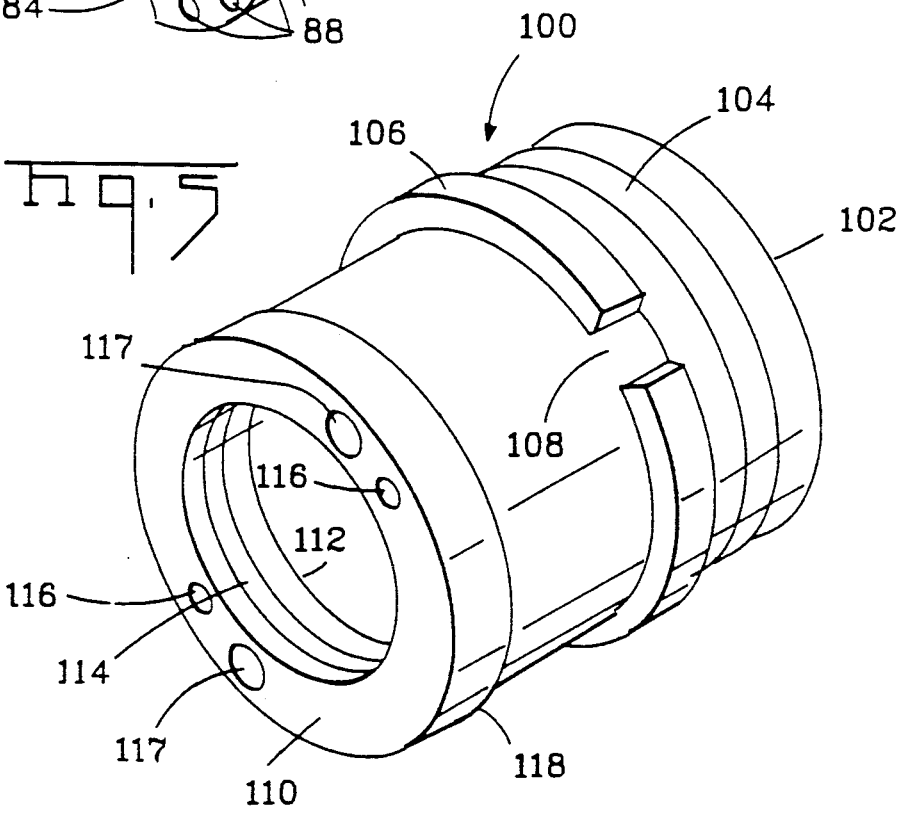
FIG. 5 is an enlarged view of the rear locking ring.

Referring now to FIG. 5, the rear locking ring 100 is shown as including a front section 102 having a groove 104 therein. The ring 100 also includes an integral section 106 which has a locating cutout 108 therethrough. A rear section 118 of the ring 100 includes a forwardly directed face 112, and a rearwardly projecting face 114. A rear face 110 has two through holes 116 which are aligned with the alignment dowels 90 in stop ring 70, and two through holes 117 for receipt therethrough of the lanyard 40.

To assembly the connectors as discussed herein, the terminals and sockets are first assembled within the shell 2 and body 20 as taught in European Patent Application No. 89303801.9. The shell member 2 can then be fixedly mounted to the aircraft adjacent to the pilot's compartment.

Figure 6:
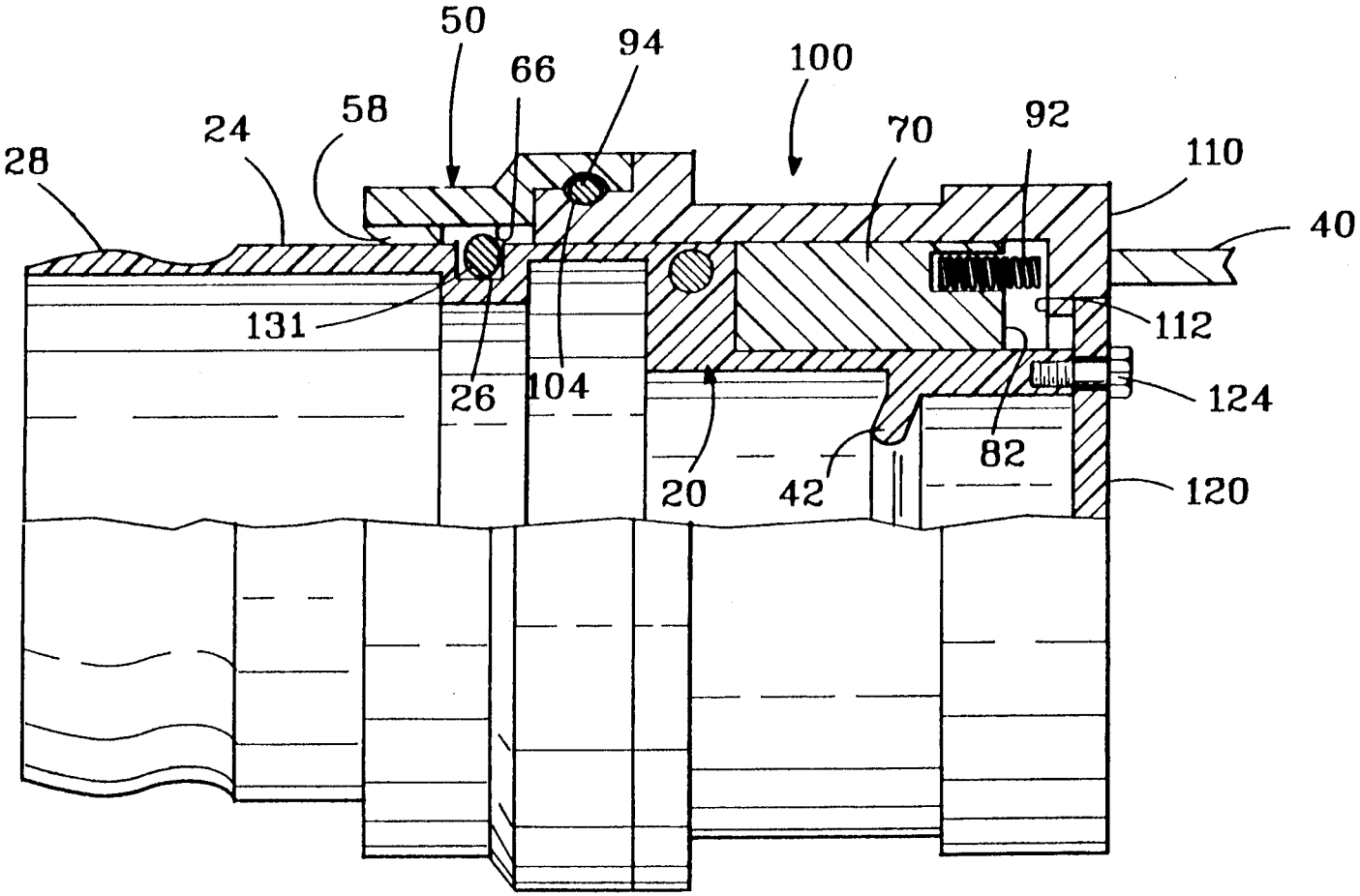
FIG. 6 is a quarter cross-section showing the assembled pilot helmet connector half.

To assemble the pilot's connector, the lanyard 40 is first threaded through the apertures 117 of the rear locking ring and the ends of the lanyard are then fixedly connected to the body 20 through an aperture adjacent to the cam members 36, as shown in FIG. 3. The stop ring assembly can then be assembled and inserted within the rear lock ring. The locking pegs 90 are inserted into apertures 86 (FIG. 4) of the stop ring 70, and the compression springs 92 are installed within the apertures 88 (FIG. 4). The stop ring 70 can now be inserted within the rear lock ring 100, making sure that the lanyard 40 is laced along its grooved path 84 of the stop ring 70. When in place, the pegs 90 are inserted within the apertures 116 at the rear of the lock ring 100. This places the spring 92 in compression against the forwardly directed face 112 of the rear lock ring as shown in FIG. 6. The connector body 20 and the rear lock ring can now be brought together, with the stop ring 70 sandwiched therebetween, and the rear section 30 of the body 20 can be inserted into the rear section 118 of the lock ring 100. This exposes the threaded holes 34 through the opening at the rear of the lock ring 100. The washer 120 can then be fixed to the rear of the lock ring 100, by means of fasteners 124 and threaded openings 34, to retain the connector body 20 to the rear lock ring 100.

The circlip 94 is then spring loaded into the groove 104 at the forward end of the rear locking ring 100, and the forward locking ring can be inserted over the rear locking ring !00 until the internal groove 60 of the forward lock ring 50 snaps over the circlip 94. The locating tabs 56 of the forward lock ring 50 are inserted within the openings 108 of the rear lock ring 100. It should be understood then, that the three components: the forward lock ring 50, the rear lock ring 100 and the stop ring 70 rotate as one fixed unit. However, the stop ring can move axially relative to the rear s top ring to the extend shown between surfaces 82 and 112, as shown in FIG. 6.

It should also be noted that the cam member 36 on the connector body 20 is complementary with the cam openings 78 and 80 on the stop ring 70. An abutment 79 is located between the two cam openings 78 and 80 which defines two detented stop positions for the cam 36 within the cam openings, or said differently, two detented positions between the connector body 20 and the lock assembly. Preferably, the connector body is rotatable relative to the lock rings 50, 70, 100, by an angle of approximately 70°.

With the pilot connector assembled, the function of the connector assembly is as follows. When the pilot connector assembly is in the unmated condition, the cams 36 are located with the cam stops 80. When the pilot connector assembly is offered up to shell 2, the two connectors are polarized via the projection 16 and slot 38, which of course aligns respective sockets and terminals within the connector halves for mating. However, the combination of the projection 16 and slot 38 also rotatably fixes the connector body 20 and shell 2. The lock ring assembly 130, is however, rotatable relative to the shell, and relative to the connector body 20. With the threads 58 and 12 in a complementary position, the lock ring assembly 130 can be rotated to move the cam 36 to the detented position within cam stop 78. As the lock ring assembly 130 is rotated, the stop ring 70 moves rearwardly in order that the abutment 79 clears the cam member 36. When in the fully mated position, the conductive 0-ring 131 (FIG. 6) is in compression with the inner surface 14 of the shell member for RFI sealing.

In the event of an ejection of the pilot, the tension on the lanyard 40, which is connected to the pilot, causes a counterclockwise (as viewed in FIG. 1) torque on the groove 84, in which it resides, and an axial force which tends to retract the stop ring 70 away from the connector body 20. This combination of torque and axial force causes a rotation of the stop ring 70, which causes the entire lock ring assembly 130 to rotate, and the two connector halves to become disengaged. Advantageously, the load due to disengagement of the connector halves is reduced by the mechanical advantage provided by the screw threads 58 and 12. In the preferred embodiment of the invention, the angle of the cam faces 81 and 83 is 30° while the angle of the screw threads is 15°. Similarly, the linear acceleration of the connector body 2 is similarly geared down with respect to the acceleration of the lanyard 40, which reduces the shock to the connector system.

To provide for a fail-safe system, the circlip 94 can contract somewhat to discharge the forward lock ring 50. This discharge would break the connection between the connector body 20 and the connector shell 2.

Due to the spherical nose 28, the connector shell 20 does not become bound when the connector body 20 and the shell are disengaged. It has been found that the disconnection axis of the lanyard can be 30° relative to the connection axis, or said differently, there is a 60° cone of disconnection.

We claim:

1. A rapid disconnect electrical connector assembly comprising first and second matable connector members, the said first connector member including a mating front section and a first plurality of electrical terminals, the said second connector member including a connector body member containing a second set of electrical terminals, where the forward section of said second connector member is spherically shaped such that said second connector member can be removed from said first connector member at an angle relative to the connection axis, a locking ring assembly operatively connected to said connector body member and rotatable relative thereto, and a lanyard attached to said connector body member of said second connector member and operatively connected to the locking ring assembly, said locking ring assembly including (i) a radial groove which carries said lanyard, (ii) a detent means which allows first and second detented positions of the locking means and said connector body, and (iii) a stop ring and a forward lock ring operatively connected together, whereby axial tension on the lanyard causes a torsional action on the locking ring assembly to thereby cause disconnection of said first and second connector members.

2. The connector assembly according to claim 1 wherein the forward lock ring and the first connector member include complementary threaded portions to lock the two connector members together.

3. The connector assembly according to claim 1, wherein the forward section of the second connector member is spherically shaped, such that the second connector member can be removed from the first connector member at an angle relative to the connection axis.

* * * * *